US008998642B2

(12) United States Patent
Manter et al.

(10) Patent No.: US 8,998,642 B2
(45) **Date of Patent: *Apr. 7, 2015**

(54) CONNECTOR WITH IMPROVED SHIELDING IN MATING CONTACT REGION

(75) Inventors: David Paul Manter, Windham, NH (US); Thomas S. Cohen, New Boston, NH (US)

(73) Assignee: Amphenol Corporation, Wallingford, CT (US)

( * ) Notice: Subject to any disclaimer, the term of this patent is extended or adjusted under 35 U.S.C. 154(b) by 50 days.

This patent is subject to a terminal disclaimer.

(21) Appl. No.: 13/336,564

(22) Filed: Dec. 23, 2011

(65) Prior Publication Data

US 2012/0156929 A1 Jun. 21, 2012

Related U.S. Application Data

(63) Continuation of application No. 11/476,758, filed on Jun. 29, 2006, now Pat. No. 8,083,553.

(51) Int. Cl.

| | |
|---|---|
| ***H01R 13/502*** | (2006.01) |
| ***H01R 13/518*** | (2006.01) |
| ***H01R 13/514*** | (2006.01) |
| ***H01R 12/52*** | (2011.01) |

(52) U.S. Cl.
CPC ..... *H01R 13/518* (2013.01); *H01R 13/514* (2013.01); *H01R 12/52* (2013.01)

(58) Field of Classification Search
USPC ..... 439/701, 607.5–607.11, 295, 607.07
See application file for complete search history.

(56) References Cited

U.S. PATENT DOCUMENTS

| | | | | |
|---|---|---|---|---|
| 3,786,372 | A | 1/1974 | Epis et al. | |
| 4,846,727 | A * | 7/1989 | Glover et al. | 439/607.07 |
| 5,605,469 | A | 2/1997 | Wellinsky et al. | |
| 6,238,245 | B1 | 5/2001 | Stokoe et al. | |
| 6,503,103 | B1 | 1/2003 | Cohen et al. | |
| 6,579,116 | B2 | 6/2003 | Brennan et al. | |
| 6,607,402 | B2 | 8/2003 | Cohen et al. | |
| 6,709,294 | B1 * | 3/2004 | Cohen et al. | 439/607.07 |
| 6,776,659 | B1 | 8/2004 | Stokoe et al. | |

(Continued)

FOREIGN PATENT DOCUMENTS

| | | |
|---|---|---|
| CN | 1398446 A | 2/2003 |
| GB | 1272347 A | 4/1972 |

(Continued)

OTHER PUBLICATIONS

Chinese Office Action dated May 6, 2014 issued in Chinese Patent Application No. 201210249710.9, with English Translation.

*Primary Examiner* — Neil Abrams
*Assistant Examiner* — Travis Chambers
(74) *Attorney, Agent, or Firm* — Blank Rome LLP

(57) ABSTRACT

An electrical connector system includes a daughter card connector formed of a plurality of wafers. Each wafer is formed with cavities between the contacts of the signal conductors. The cavities are shaped to receive lossy inserts whereby crosstalk is reduced. The connector system may also or alternatively include a front housing formed with shield plates also to aid in reducing cross-talk. The front housing is adapted to mate between the wafers of the daughter card connector and a backplane connector of the electrical connector system. In an alternative embodiment, the front housing portion may include lossy conductive portions for cross-talk reduction.

14 Claims, 7 Drawing Sheets

(56) References Cited

U.S. PATENT DOCUMENTS

| | | | | |
|---|---|---|---|---|
| 6,786,771 | B2 | 9/2004 | Gailus | |
| 6,808,419 | B1 | 10/2004 | Korsunsky et al. | |
| 7,057,570 | B2 | 6/2006 | Irion, II et al. | |
| 8,083,553 | B2 * | 12/2011 | Manter et al. | 439/701 |
| 2001/0046810 | A1 | 11/2001 | Cohen et al. | |
| 2002/0102885 | A1 | 8/2002 | Kline | |
| 2002/0168898 | A1 | 11/2002 | Billman et al. | |
| 2003/0003803 | A1 | 1/2003 | Billman et al. | |
| 2003/0143894 | A1 | 7/2003 | Kline et al. | |
| 2004/0121652 | A1 | 6/2004 | Gailus | |
| 2004/0196112 | A1 | 10/2004 | Welbon et al. | |
| 2005/0059961 | A1 | 3/2005 | Kurtzer et al. | |
| 2007/0037419 | A1 | 2/2007 | Sparrowhawk | |

FOREIGN PATENT DOCUMENTS

| | | | |
|---|---|---|---|
| WO | 9835409 | A1 | 8/1998 |
| WO | 0157963 | A2 | 8/2001 |

* cited by examiner

CONNECTOR WITH IMPROVED SHIELDING IN MATING CONTACT REGION

CROSS-REFERENCE TO RELATED APPLICATION

This application claims priority to U.S. Provisional Patent Application Ser. No. 60/695,264, filed Jun. 30, 2005, the contents of which are incorporated herein by reference.

BACKGROUND OF THE INVENTION

1. Field of Invention

This invention relates generally to electrical interconnection systems and more specifically to electrical interconnection systems, such as high speed electrical connectors, with improved signal integrity.

2. Discussion of Related Art

Electrical connectors are used in many electronic systems. Electrical connectors are often used to make connections between printed circuit boards ("PCBs") that allow separate PCBs to be easily assembled or removed from an electronic system. Assembling an electronic system on several PCBs that are then connected to one another by electrical connectors is generally easier and more cost effective than manufacturing the entire system on a single PCB.

Electronic systems have generally become smaller, faster and functionally more complex. These changes mean that the number of circuits in a given area of an electronic system, along with the frequencies at which those circuits operate, have increased significantly in recent years. Current systems pass more data between PCBs than systems of even a few years ago, requiring electrical connectors that are more dense and operate at higher frequencies.

Despite recent improvements in high frequency performance of electrical connectors provided by shielding, it would be desirable to have an interconnection system with even further improved performance.

SUMMARY OF THE INVENTION

The present invention is directed to overcoming the above-identified deficiencies of the background art. To this end, one aspect of the invention provides a method of manufacturing an electrical connector, the method including: molding an insulative housing over at least a portion of a frame, the frame including at least two signal conductors; forming at least one cavity between the at least two signal conductors; and inserting at least one electrically lossy material into the at least one cavity.

Another aspect of the invention provides an electrical connector that includes: at least one signal conductor; at least one insulative material adapted to be positioned at least a portion of the at least one signal conductor; and at least one electrically lossy material positioned at the at least one insulative material.

Yet another aspect of the invention provides a housing configured to be used with a daughter card connector of an electrical connection system, the housing including: a body including at least one aperture adapted to receive a mating portion of the daughter card connector; and at least one shield member positioned proximate to the at least one aperture.

Additionally, the present invention provides a method of manufacturing at least a portion of an electrical connector system, the method including: molding a housing with at least one aperture adapted to receive at least a portion of a daughter card connector; forming at least one slot proximate to the at least one aperture; and inserting at least one shield member into the at least one slot.

BRIEF DESCRIPTION OF THE DRAWINGS

The accompanying drawings are not intended to be drawn to scale. For purposes of clarity, not every component may be labeled in every drawing. In the drawings.

DETAILED DESCRIPTION OF THE EMBODIMENTS

Figure 1:
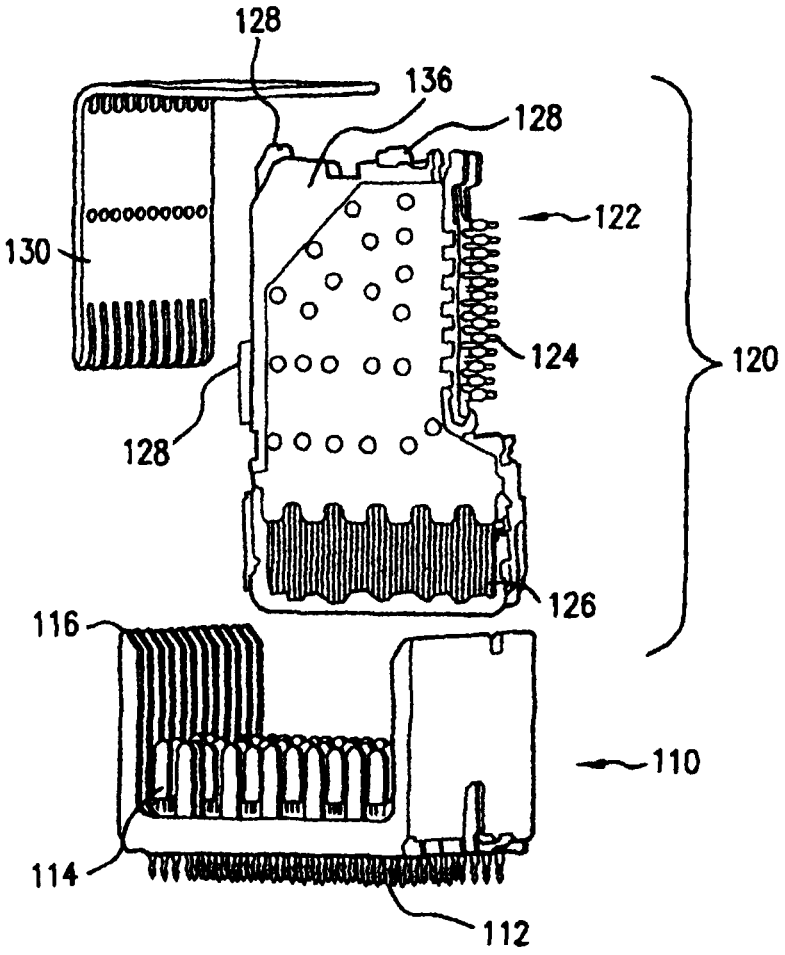
FIG. 1 illustrates a related connector.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof, as well as additional items.

As connectors become more dense and signal frequencies increase, there is a greater possibility of electrical noise being generated in the connector as a result of reflections caused by impedance mismatch or cross-talk between signal conductors. Therefore, electrical connectors are designed to control cross-talk between different signal paths and to control the impedance of each signal path. Shield members, which are typically a metal strip or a metal plate connected to a ground, can influence both cross-talk and impedance when placed adjacent the signal conductors. Shield members with an appropriate design can significantly improve the performance of a connector. U.S. Pat. No. 6,709,294 (the '294 patent), which is assigned to the same assignee as the present application and which is hereby incorporated by reference in its entirety, describes making an extension of a shield member in a connector from conductive plastic. U.S. Pat. No. 6,786,771, (the '771 patent), which is assigned to the assignee of the present application and which is hereby incorporated by reference in its entirety, describes the use of lossy material to reduce unwanted resonances and improve connector performance, particularly at high speeds (for example, signal frequencies of 1 GHz or greater, particularly above 3 GHz).

High frequency performance is sometimes improved through the use of differential signals. Differential signals are signals represented by a pair of conducting paths, called a "differential pair." The voltage difference between the conductive paths represents the signal. In general, the two conducing paths of a differential pair are arranged to run near each other. In differential connectors, it is also known to position a pair of signal conductors that carry a differential signal may be positioned closer together than either of the signal conductors in the pair is to other signal conductors.

FIG. 1 shows an exemplary connector system that may be improved according to the invention. In the example of FIG. 1, the electrical connector is a two-piece electrical connector adapted for connecting printed circuit boards to a backplane at right angles. The connector includes a backplane connector 110 and a daughter card connector 120 adapted to mate to the backplane connector 110.

Backplane connector 110 includes multiple signal conductors generally arranged in columns. The signal conductors are held in housing 116, which is typically molded of plastic or other suitable material. Each of the signal conductors includes a contact tail 112 and a mating portion 114. In use, the contact tails 112 may be attached to conducting traces within a backplane. In the illustrated exemplary embodiment, contact tails 112 are press-fit contact tails that are inserted into holes in the backplane. The press-fit contact tails make an electrical connection with conductive plating inside the backplane that is in turn connected to a trace within the backplane. Other forms of contact tails are known and the invention is not limited to any specific form. For example, electrical connectors may be constructed with surface mount or pressure mount contact tails.

In the example of FIG. 1, the mating portions 114 of the signal conductors are shaped as blades. The mating portions 114 of the signal conductors in the backplane connector 110 are positioned to mate with mating portions of signal conductors in daughter card connector 120. In this example, mating portions 114 of backplane connector 110 mate with mating portions 126 of daughter card connector 120, creating a separable mating interface through which signals may be transmitted.

The signal conductors within daughter card connector 120 are held within a housing 136, which may be formed of plastic or other suitable material. Contact tails 124 extend from the housing and are positioned for attachment to a daughter card. In the example of FIG. 1, contact tails 124 of daughter card connector 120 are press-fit contact tails similar to contact tails 112. However, any suitable attachment mechanism may be used.

In the illustrated non-limiting example, daughter card connector 120 is formed from wafers 122. For simplicity, a single wafer 122 is shown in FIG. 1. Wafers such as wafer 122 may be formed as subassemblies that each contain signal conductors for one column of the connector. The wafers may be held together in a support structure, such as a metal stiffener 130. Each wafer includes attachment features 128 in its housing that may attach the wafer 122 to stiffener 130.

Stiffener 130 is one example of a support structure that may be used to form a connector, but the invention is not limited for use in connection with connectors having stiffeners. Support structures may be provided in the form of insulated housings, combs, and metal members of other shapes, as examples. Further, in some embodiments, a support member may be omitted entirely. Wafers may be held together by adhesive or other means. As another example, the connector may be formed as a unitary housing into which signal conductors are inserted.

When assembled into a connector, the contact tails 124 of the wafers extend generally from a face of an insulated housing of daughter card connector 120. In use this face is pressed against a surface of a daughter card (not shown), making connection between the contact tails 124 and signal traces within the daughter card. Similarly, the contact tails 112 of backplane connector 110 extend from a face of housing 116. This face is pressed against the surface of a backplane (not shown), allowing the contact tails 112 to make connection to traces within the backplane. In this way, signals may pass from a daughter card through the signal conductors in daughter card 120, into the signal conductors of backplane connector 110 where they may be connected to traces within a backplane.

Where desired, shield members may be placed between the columns of signal conductors in the backplane connector and the daughter card connector. These shields may likewise include contact portions that allow current to pass across the mating interface between the daughter card connector 120 and backplane connector 110. Such shield members may be connected to a ground plane within the daughter card or the backplane, providing a ground plane through the connector that reduces crosstalk between signal conductors and may also serve to control the impedance of the signal conductors.

Figure 2B:
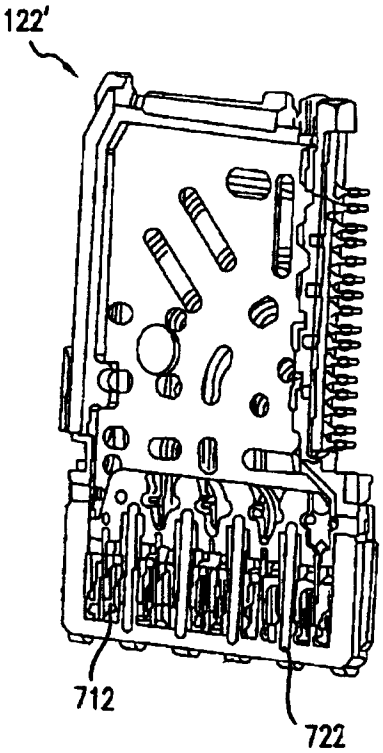
FIG. 2B is a front view of the exemplary electrical connector of FIG. 2A.
Figure 2A:
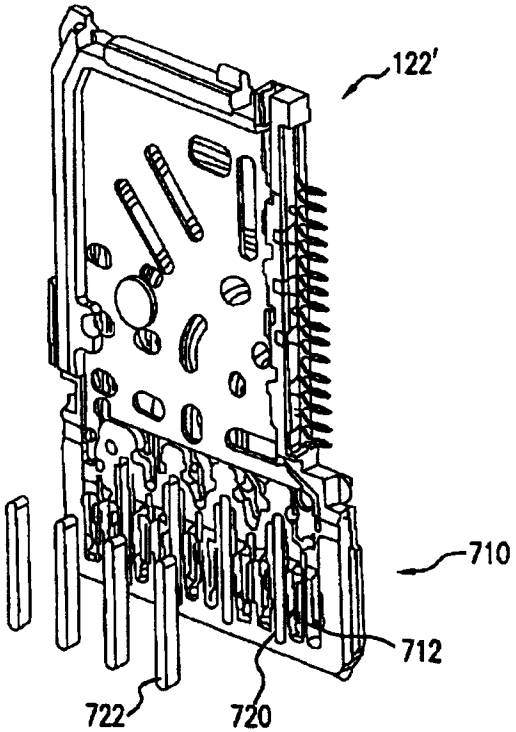
FIG. 2A is a partially exploded view of an exemplary embodiment of an electrical connector.

According to one non-limiting aspect of the invention, an arrangement by which crosstalk may be reduced in shown in FIGS. 2A and 2B. FIG. 2A shows a wafer 122' that includes features for crosstalk reduction in an interconnection system. Mating portion 710 is shaped to fit within housing 116 of backplane connector 110. Mating portion 710 includes mating portions 712 of the signal conductors within wafer 122' that engage mating portions 114 of the signal conductors within backplane connector 110 (FIG. 1). In the embodiment illustrated, the mating portions 712 are positioned in pairs. However, other configurations are within the scope of this invention.

Wafer 122' may be formed with cavities 720 between the signal conductors within mating portion 710. Cavities 720 may be shaped to receive lossy inserts 722. Lossy inserts 722 may be made from or contain materials generally referred to as lossy conductors or lossy dielectric(s), referred to generally as "electrically lossy materials." Electrically lossy materials can be formed from materials that are generally thought of as conductors, but are relatively poor conductors over the frequency range of interest, contain particles or regions that are sufficiently dispersed that they do not provide high conductivity, or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter.

Electrically lossy materials may be partially conductive materials, such as those that have a surface resistivity between 1 Ω/square and $10^6$ Ω/square. In some embodiments, the electrically lossy material has a surface resistivity between about 1 Ω/square and about $10^3$ Ω/square. In other embodiments, the electrically lossy material has a surface resistivity between about 10 Ω/square and about 100 Ω/square. As a specific example, the material may have a surface resistivity of between about 20 Ω/square and about 40 Ω/square.

In some embodiments, electrically lossy material is formed by adding a filler that contains conductive particles to a binder. Examples of conductive particles that may be used as a filler to form an electrically lossy material include carbon or graphite formed as fibers, flakes, nickel-graphite powder or other particles. Metal in the form of powder, flakes, fibers, stainless steel fibers, or other particles may also be used to provide suitable electrically lossy properties. Additionally or alternatively, combinations of fillers may be used. For example, metal plated carbon particles may be used. Silver and nickel are suitable metal plating for fibers. Coated particles may be used alone or in combination with other fillers. Nanotube materials may also be used. Blends of materials may also be used and are within the scope of this invention.

Preferably, the fillers will be present in a sufficient volume percentage to allow conducting paths to be created from particle to particle. For example, when metal fiber is used, the fiber may be present in about 3% to about 40% by volume. The amount of filler may impact the conducting properties of the material. In another embodiment, the binder may be loaded with conducting filler between about 10% and about 80% by volume. The loading may be in excess of about 30% by volume. As another example, the conductive filler may be loaded between about 40% and about 60% by volume.

When fibrous filler is used, the fibers may have a length between about 0.5 mm and about 15 mm. As a specific example, the length may be between about 3 mm and about 11 mm. In one exemplary embodiment, the fiber length is between about 3 mm and about 8 mm.

In an exemplary embodiment, the fibrous filler has a high aspect ratio (ratio of length to width). In that embodiment, the fiber preferably has an aspect ratio in excess of about 10 and more preferably in excess of about 100. In another embodiment, a plastic resin is used as a binder to hold nickel-plated graphite flakes. As a specific (non-limiting) example, the lossy conductive material may be about 30% nickel coated graphite fibers, about 40% LCP (liquid crystal polymer) and about 30% PPS (Polyphenylene sulfide).

Filled materials can be purchased commercially, such as materials sold under the trade name CELESTRAN® by Ticona. Commercially available preforms, such as lossy conductive carbon filled adhesive preforms sold by Techfilm of Billerica, Mass., United States may also be used.

Lossy inserts 722 may be formed in any suitable way. For example, the filled binder may be extruded using a bar having a cross-section that is the same of the cross-section desired for lossy inserts 722. Such a bar may be cut into segments having a thickness as desired for lossy inserts 722. Such segments may then be inserted into cavities 720. The inserts may be retained in cavities 722 by an interference fit or through the use of adhesive or other securing means. As an alternative embodiment, uncured materials filled as described above may be inserted into cavities 720 and cured in place.

FIG. 2B illustrates wafer 122' with conductive inserts 722 in place. As can be seen in this view, conductive inserts 722 separate the mating portions 712 of pairs of signal conductors. Wafer 122' may include a shield member generally parallel to the signal conductors within wafer 122'. Where a shield member is present, lossy inserts 722 may be electrically coupled to the shield member and form a direct electrical connection. Coupling may be achieved using a conductive epoxy or other conducting adhesive to secure the lossy insert to the shield member. Alternatively, electrical coupling between lossy inserts 722 and a shield member may be achieved by pressing lossy inserts 722 against the shield member. Close physical proximity of lossy inserts 722 to a shield member may achieve capacitive coupling between the shield member and the lossy inserts. Alternatively, if lossy inserts 722 are retained within wafer 122' with sufficient pressure against a shield member, a direct connection may be formed.

However, electrical coupling between lossy inserts 722 and a shield member is not required. Lossy inserts 722 may be used in connectors without a shield member to reduce crosstalk in mating portions 710 of the interconnection system. According to another aspect of the invention, each wafer may include one or more features described in co-pending patent application filed on even date herewith and designated as claiming priority to provisional patent application Ser. No. 60/695,308, the contents of which are incorporated by reference in their entireties. In one non-limiting embodiment, the wafer is formed with two housing portions, a first insulative portion that holds and separates conductive signal pairs and a second conductive portion to provide the desired shielding. Conductive ground strips in the wafer may be formed in the same plane as the conductive signal strips and the second housing portion (e.g., that portion of the housing that is conductive) is connected (e.g., molded) to the ground strips and spaced appropriately from the signal strips. The wafer may also be formed with air gaps between the conductive strips (e.g., signal strips) of one wafer and the conductive housing of an adjacent wafer further reduces electrical noise or other losses (e.g., cross-talk) without sacrificing significant signal strength. This phenomenon occurs, at least in part, because the air gap provides preferential signal communication or coupling between one signal strip of a signal pair and the other signal strip of the signal pair, whereas shielding is used to limit cross-talk amongst signal pairs.

Figure 3A:
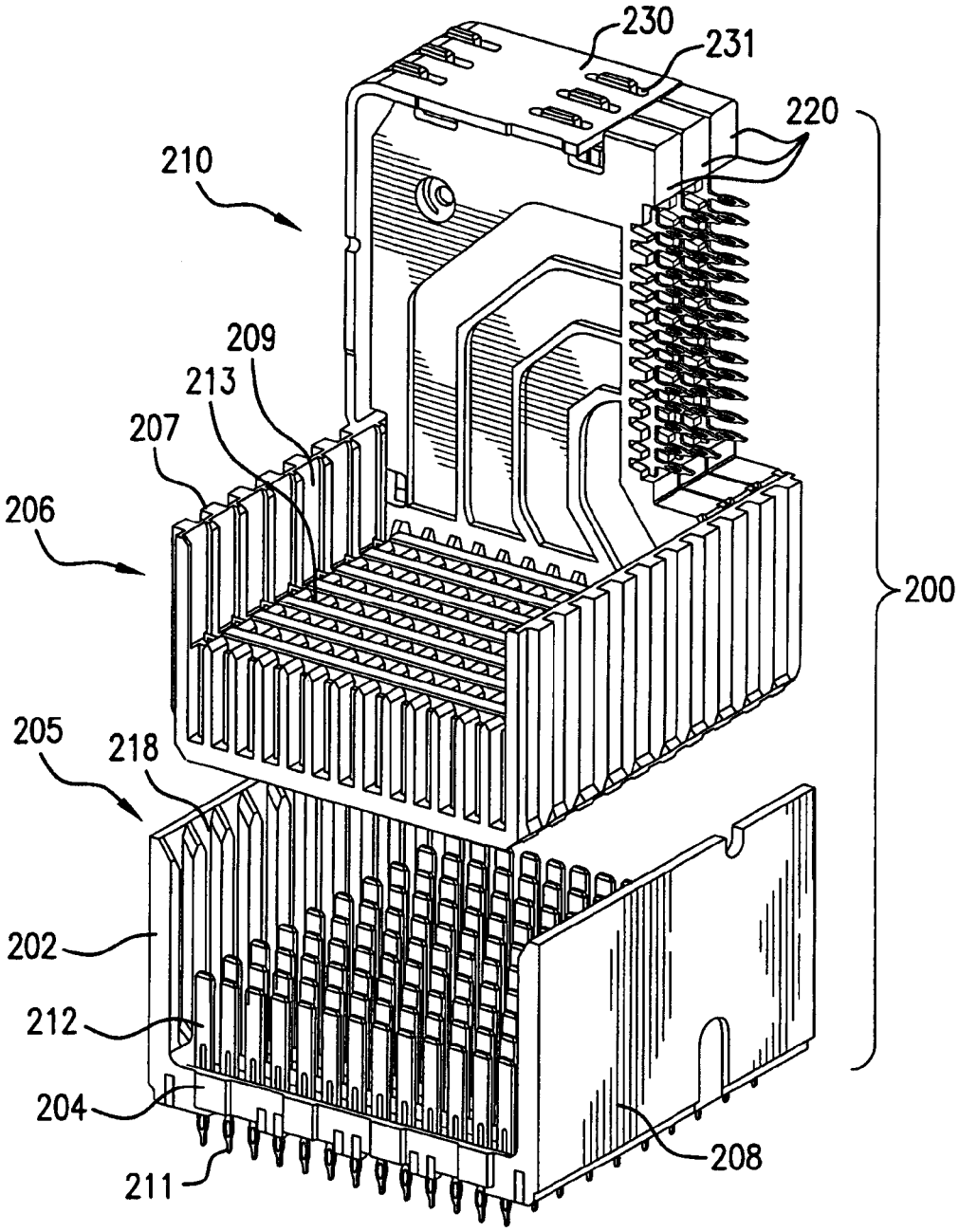
FIG. 3A is a partially exploded view of an exemplary embodiment of an electrical connector system.

According to another aspect of the invention, the connector may be formed as shown in FIG. 3A (such as described in the application having incorporated above). As shown in FIG. 3A, a multi-piece electrical connector 200 may include a backplane connector 205 and a daughter board connector 210 that includes front housing 206. The backplane connector 205 includes a backplane shroud 202 and a plurality of contacts 212, here arranged in an array of differential signal pairs. In the illustrated non-limiting embodiment, the contacts may be connected to a printed circuit board grouped in pairs, such as may be suitable for carrying a differential signal. Each pair may be spaced from one adjacent pair by a contact connected to ground. A single-ended configuration of the signal contacts 212 in which the conductors are not grouped in pairs is also within the scope of the invention.

In the embodiment illustrated, the backplane shroud 202 is molded from a dielectric material. Examples of such materials are liquid crystal polymer (LCP), polyphenyline sulfide (PPS), high temperature nylon or polypropylene (PPO). Other suitable materials may be employed, as the present invention is not limited in this regard. All of these are also suitable for use as binder materials in manufacturing connectors according to the invention.

The contacts 212 extend through a floor 204 of the backplane shroud 202 providing a contact area both above and below the floor 204 of the shroud 202. Here, the contact area of the contacts 212 above the shroud floor 204 are adapted to mate to contacts in daughter card connector 210. In the illustrated embodiment, the mating contact area is in the form of a blade contact, although other suitable contact configurations may be employed, as the present invention is not limited in this regard.

A tail portion 211 of contact 212 extends below the shroud floor 204 and is adapted to mate to a printed circuit board. Here, the tail portion is in the form of a press fit, e.g., "eye of the needle" compliant contact. However, other configurations are also suitable, such as surface mounted elements, spring contacts, solderable pins, etc., as the present invention is not limited in this regard. In one embodiment, the daughter board connector 210 may include a front housing 206, which fits between side walls 208 of backplane connector 205.

The backplane shroud 202 may further include side walls 208 which extend along the length of opposing sides of the backplane shroud 202. The side walls 208 include grooves 218 which run vertically along an inner surface of the side walls 208. Grooves 218 serve to guide front housing 206 via mating projections 207 into the appropriate position in shroud 202. In some embodiments, a plurality of shields (not shown) may be provided and may run parallel with the side walls 208 and may be located between rows of pairs of signal contacts 212. In a single ended configuration, the plurality of shield plates could be located between rows of signal contacts 212. However, other shielding configurations are within the scope of this invention, including having the shields running between the walls of the shrouds, transverse to side walls 208 or omitting the shield entirely. If used, the shields may be stamped from a sheet of metal, and may be shaped as plates or blades or provided with any other desired shape.

Each shield, if used, may include one or more tail portions, which extend through the shroud floor 204. As with the tails of the signal contacts, shields may have tail portions formed as an "eye of the needle" compliant contact which is press fit into the backplane. However, other configurations are also suitable, such as surface mount elements, spring contacts, solderable pins, etc., as the present invention is not limited in this regard.

As mentioned above, the daughter board connector 210 includes a plurality of modules or wafers 220 that are supported by a support 230. Each wafer 220 includes features which are inserted into apertures 231 in the support to locate each wafer 220 with respect to another and further to prevent rotation of the wafer 220. Of course, the present invention is not limited in this regard, and no support need be employed. Further, although the support is shown attached to an upper and side portion of the plurality of wafers, the present invention is not limited in this respect, as other suitable locations may be employed.

For exemplary purposes only, the daughter board connector 210 is illustrated With three wafers 220, with each wafer 220 having pairs of signal conductors surrounded by or otherwise adjacent a ground strip. However, the present invention is not limited in this regard, as the number of wafers and the number of signal conductors and shield strips in each wafer may be varied as desired. Each wafer is inserted into front housing 206 along slots 209, such that the mating contact portions (224, 226, FIG. 3B) are inserted into cavities 213 so as to be positioned to make electrical connection with signal contacts 212 of the backplane connector 205 when the daughter card connector and backplane connection are mated.

Figure 3B:
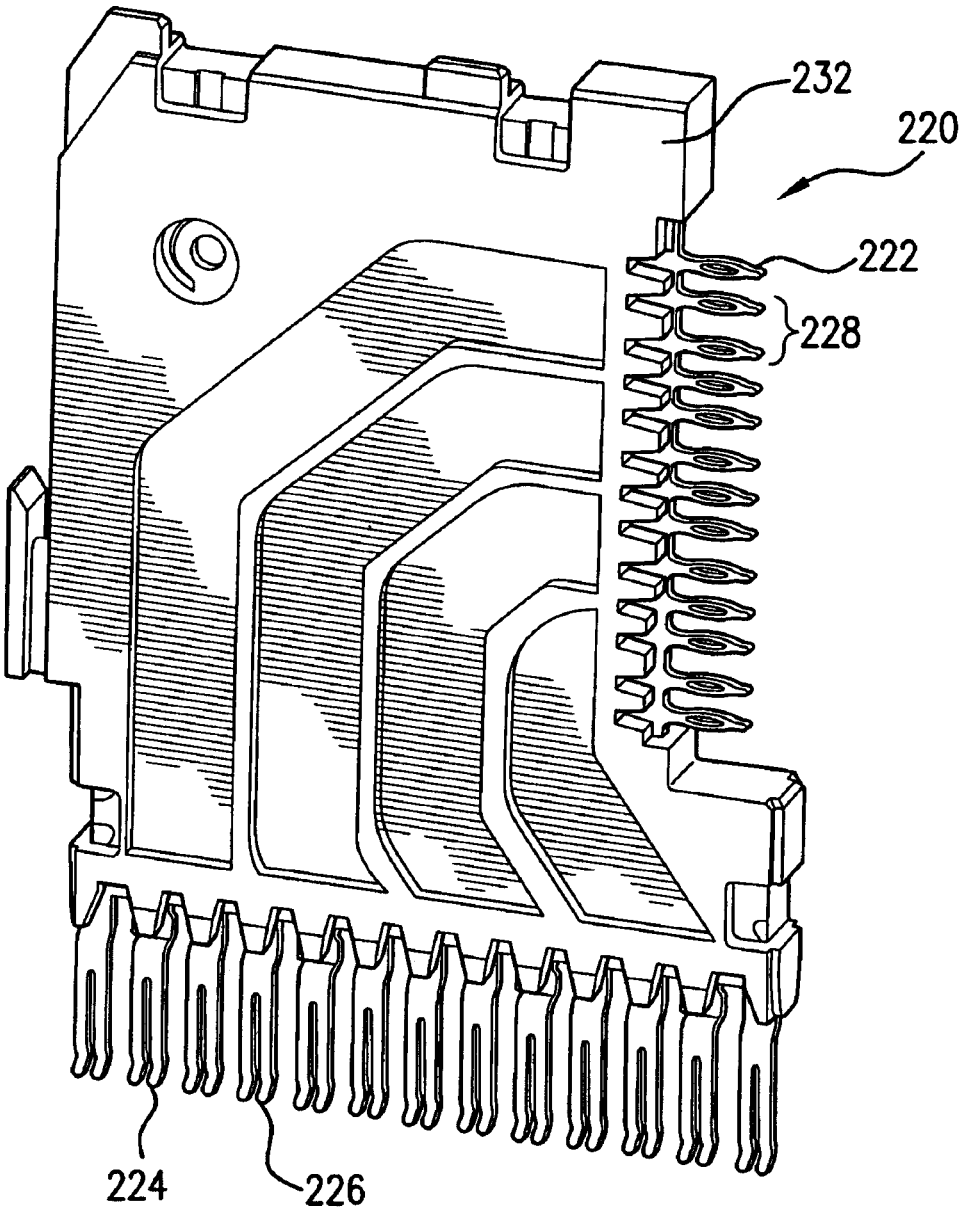
FIG. 3B is a sketch of an exemplary electrical connector shown in FIG. 3A.

Referring now to FIG. 3B, a single wafer of the daughter board connector is shown. Wafer 220 includes a two part housing 232 formed around a lead frame of signal strips and ground strips (also referred to as ground strips). Wafer 220 in one embodiment is formed by molding a first insulative portion around a lead frame containing conductive strips that will form both signal conductors and ground conductors in the connector. A second molding operation may be performed to mold a second, conductive portion of the housing around the sub-assembly of the lead frame molded to the first insulative portion. The second portion may be formed from a binder filled with conductive fillers. The fillers may create a lossy conductive portion as described above or may be more conductive and/or less lossy.

Extending from a first edge of each wafer 220 are a plurality of signal contact tails 228 and a plurality of ground contact tails 222, which extend from first edges of the corresponding strips of the lead frame. In the example of a board to board connector, these contact tails connect the signal strips and the ground strips to a printed circuit board. In an exemplary embodiment, the plurality of ground contact tails and signal contact tails 222 and 228 on each wafer 220 are arranged in a single plane, although the present invention is not limited in this respect. Also in another exemplary embodiment, the plurality of signal strips and ground strips on each wafer 220 are arranged in a single plane, although the present invention is not limited in this respect.

Here, both the signal contact tails 228 and the ground contact tails 222 are in the form of press fit "eye of the needle" configurations, which are pressed into plated through holes located in a printed circuit board (not shown). In this exemplary embodiment, the signal contact tails 228 may connect to signal traces on the printed circuit board and the ground contact tails 222 may connect to a ground plane in the printed circuit board. In the illustrated embodiment, the signal contact tails 228 are configured to provide a differential signal and are arranged in pairs.

Near a second edge of each wafer 220 are mating contact portions 224 of the signal contacts which mate with the signal contacts 212 of the backplane connector 205. Here, the mating contact portions 224 are provided in the form of dual beams to mate with the blade contact end of the backplane signal contacts is 212. In the embodiment shown, the mating contact portions are exposed for insertion into a front housing 206. However, the present invention is not limited in this respect and the mating contact regions may be positioned within openings in dielectric housing 232 to protect the contacts, as shown and described above with respect to the embodiment of FIGS. 2A and 2B.

Openings in the mating face of the daughter card connector, whether formed by a front housing 206 as shown in FIG. 3A or by housings on individual wafers as shown in FIGS. 2A and 2B, allow the contacts 212 to engage corresponding contacts in the daughter card connector for mating of the daughter board and backplane signal contacts. Other suitable contact configurations may be employed, as the present invention is not limited in this regard.

Provided between the pairs of dual beam contacts 224 and also near the second edge of the wafer are ground contacts 226. Ground contacts may be connected to daughter card ground strips and may engage the mating portion of a ground contact in the backplane connector which may be a backplane shield plate if employed. It should be appreciated that the present invention is not limited to the specific shape of the shield contact shown, as other suitable contacts may be employed. Thus, the illustrated contact is exemplary only and is not intended to be limiting.

Figure 3C:
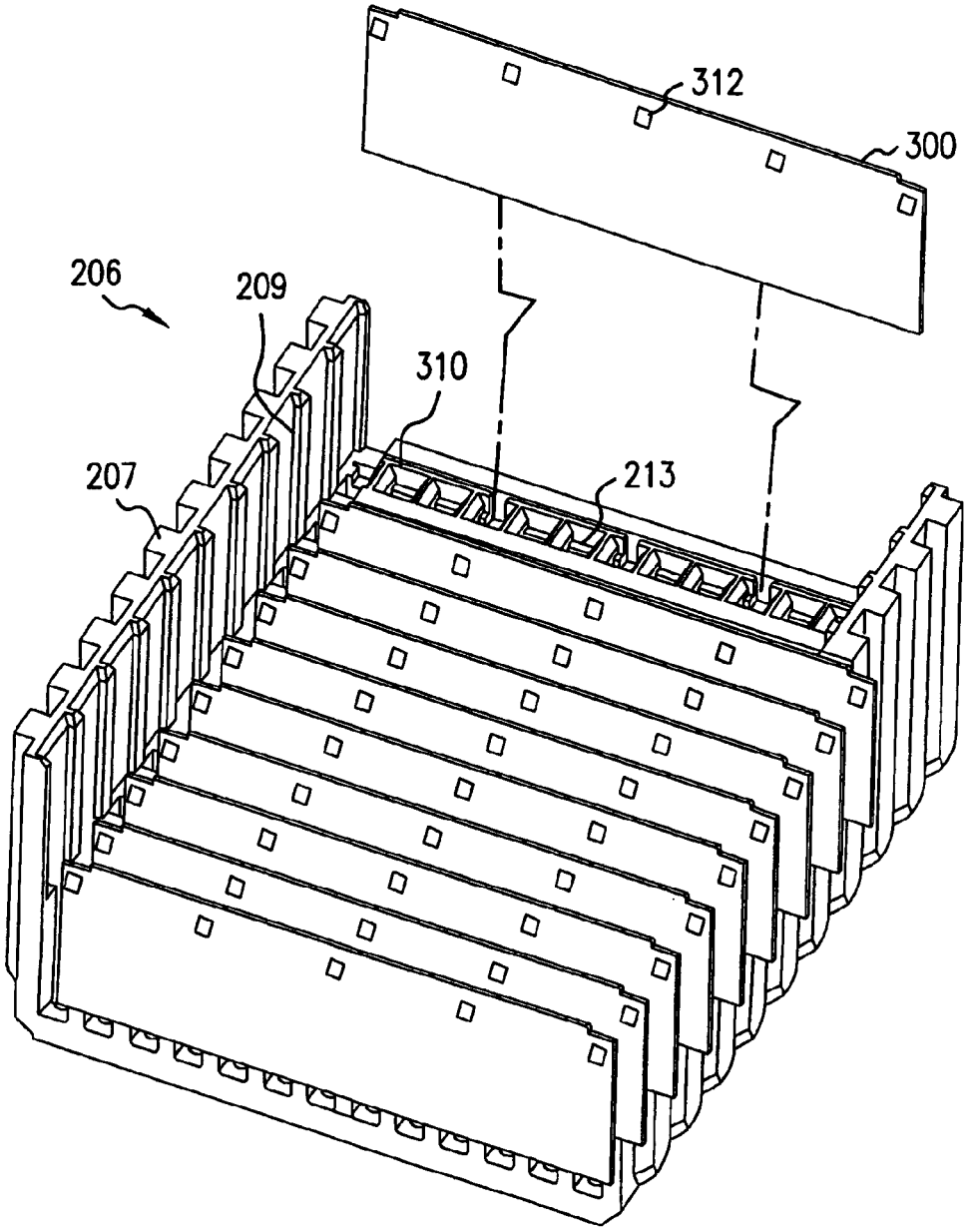
FIG. 3C is a partially exploded view of another portion of the exemplary electrical connector system shown in FIG. 3A.

Turning now to FIG. 3C, additional features of an embodiment of the front housing 206 will now be described. As shown, the front housing 206 is a generally U-shaped body and includes the above-mentioned cavities 213 that allow the tails of the wafer to connect with the blades of the backplane housing. The front housing is typically molded from a suitable material, such as any of the non-conductive materials described above. In one embodiment, the front housing is molded from of a thermoplastic binder into which non-conducting fibers are introduced for added strength, dimensional stability and to reduce the amount of higher priced binder used. Glass fibers are typical, with a loading of about 30% by volume.

According to one aspect of the invention, to reduce crosstalk where the contacts 224 mate with the backplane contacts 212, the front housing 206 is provided with shielding. This shielding may be in place of or in addition to any shield provided in the backplane connector 205 and/or in the daughter card connector 210. In one embodiment, shield plates 300 are provided at suitable locations in the front housing. As shown, the shield plates 300 may be disposed at locations in the front housing 206 such that they are positioned between adjacent columns of apertures 213. However, other suitable locations for reducing cross-talk may be employed, as the present invention is not limited in this respect. In one embodiment, each shield plate may be spaced from a column of contact portions 224 when a wafer is inserted into the front housing 206 so as to maintain an impedance of the signal conductors at less than approximately 500Ω. In one embodiment, the shield plate is spaced from the mating contact portions 224 when a wafer is inserted into the front housing 206 so as to maintain an impedance of the signal conductors at less than approximately 100Ω. In yet another embodiment, the shield plate is spaced from the contact tails 224, when a wafer is inserted into the front housing 206, so to maintain an impedance of the signal conductors at approximately 50Ω.

The shield plates may be disposed within the front housing in any suitable manner, as the present invention is not limited in this respect. In one embodiment, the front housing is formed with slots 310, which may be formed during molding of the front housing. Of course, other suitable manufacturing techniques for forming the slots, such as machining the slots after the front housing has been formed, may be employed, as the present invention is not limited in this respect. The slots 310 may be sized to receive the plates 300. The width of the slot may be such that a press fit between the front housing and the shield plate may be achieved, thereby securely holding the plates in place. Other suitable techniques for holding the plate in place, such as with the use of adhesives, fasteners, or the like may be employed, as the present invention is not limited in this respect.

In an alternative embodiment, the shield plates 310 may be molded with the housing such that upon completion of the molding operation, the shield plates are held fast within the housing.

The shield plate is configured to make electrical connections to the ground strips of the wafer. In one embodiment, the shield plate includes tabs 312, which may be biased, to engage with the contact tails 226 of the wafer upon insertion of the wafer in the front housing.

In one embodiment, the shield plate is formed from metal; however, the present invention is not limited in this respect, as suitable conductive plastics, such as the above-described lossy material, may be employed. In one embodiment, the shield plate may be formed by stamping a metal plate, although the plate may be cast, machined, or formed by other suitable methods as the present invention is not limited in this respect. Further, tabs 312 may be formed during the stamping operation.

Figure 4A:
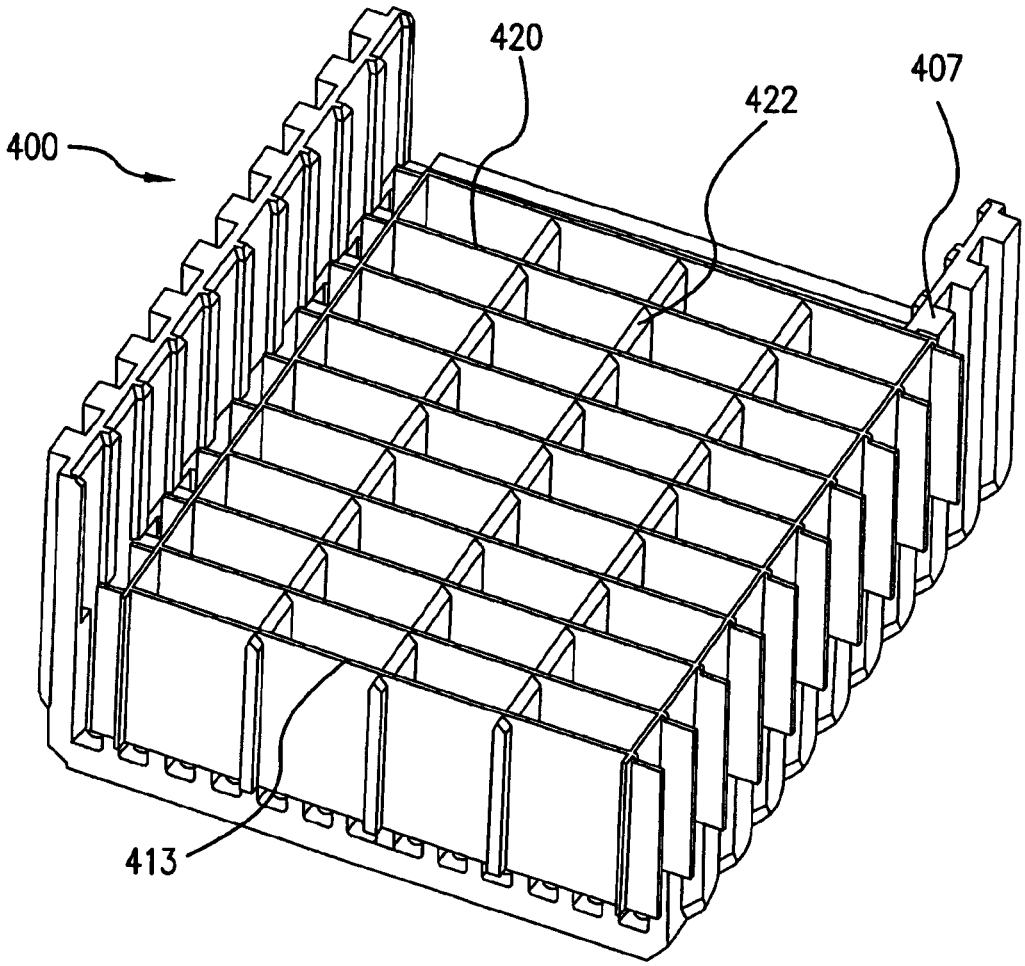
FIG. 4A is a sketch of an exemplary alternative embodiment of a front housing portion of a daughter card connector.
Figure 4B:
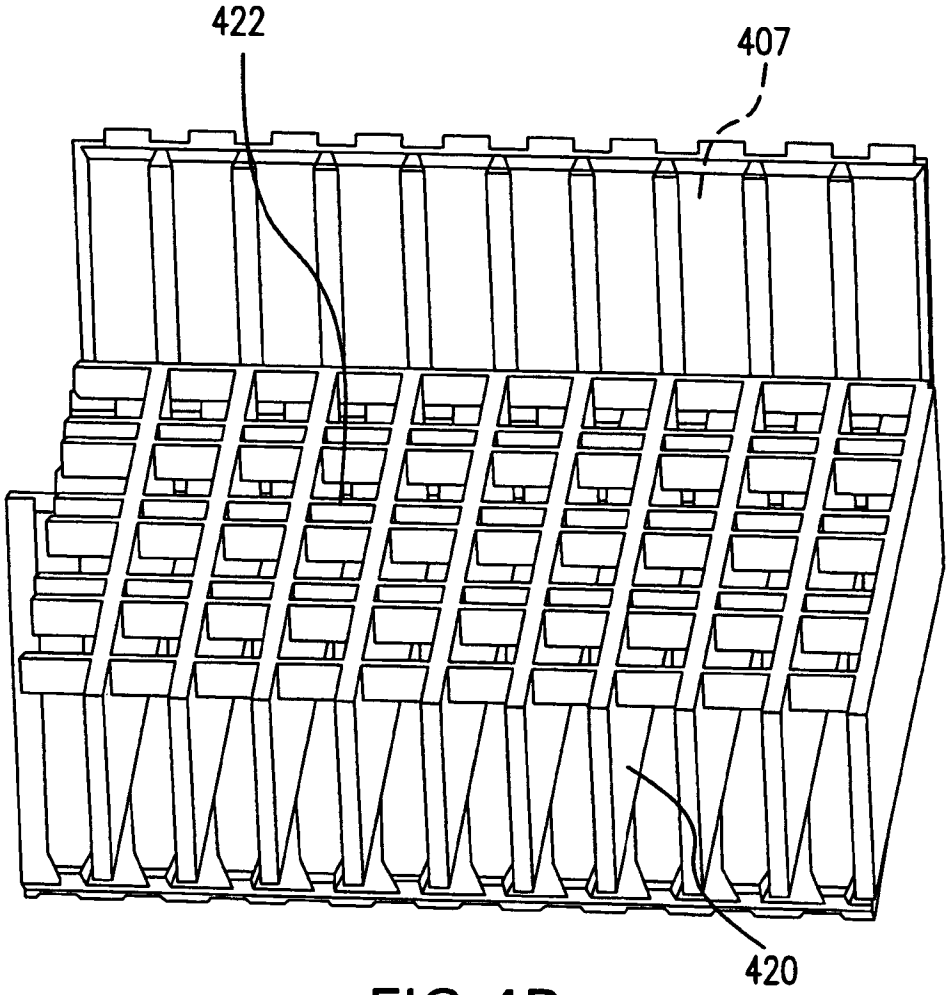
FIG. 4B is a side view of a front housing portion of an exemplary daughter card connector shown in FIG. 4A.

FIGS. 4A and 4B show an alternative embodiment of front housing 206, where FIG. 4A shows an assembled perspective view of the completed front housing. Front housing portion 400 is formed without shield members 300. Cross talk reduction is provided in front housing portion 400 through the use of electrically lossy material. The electrically lossy material may be formed as described above with conductive fillers in an insulative material serving as a binder. In one embodiment, electrically lossy material and insulative material are molded in a two shot molding operation to form an integral housing having insulative and lossy segments. As shown in FIG. 4B, which is a view of the lossy segments shown in solid lines, lossy material is molded first and then the remainder of the front housing (e.g., the insulative segment), which is shown in lighter phantom lines, is molded over the lossy segments of the housing. Of course, the present invention is not limited in this respect, as other suitable molding operations may be performed to produce a front housing have lossy segments. Further, although the lossy material is formed as a unitary lossy segment, the present invention is not so limited, as multiple, separate lossy segments may be formed in the front housing.

The lossy segments may be positioned within the insulative housing at locations desirable for cross talk suppression. In the embodiment illustrated in FIGS. 4A and 4B, front housing 400 is formed with side walls 407 of insulative material. Insulative material is also positioned such that each of the cavities 413 that receives a mating contact portion 224 of a conductor within wafer 220 intended to carry a signal is lined with insulative material in any segment that could contact the conductor. Electrically lossy material may be positioned in regions between columns of mating contact portions, such as in region 420. As shown, region 420 extends to the bottom of the front housing.

Additionally, front housing 400 may be molded with lossy material between cavities 413. In the embodiment illustrated in FIGS. 4A and 4B, the connector is configured for differential signals such that the mating contact portions are taken in pairs. Accordingly, front housing portion 400 includes regions of lossy conductive material 422 running perpendicular to the columns between pairs of cavities 413 adapted to receive the mating contact portions of two conductors carrying one differential signal. As shown, region 422 extends only partway toward the bottom of the front housing and extends to a lesser extent that region 420. Of course, the present invention is not limited in this respect, as the regions may extend by the same amount or region 422 may extend further toward the bottom of the front housing that region 420.

The amount and extent of lossy material contained within front housing portion 400 may be selected to reduce cross talk to a desired level without undesirably attenuating the signal transmitted through front housing portion 400. Portions 420 between adjacent columns may be used instead of or in addition to portions 422 running perpendicular to the columns. Additionally, lossy material may be used in front housing portion instead of or in addition to shield members such as are pictured in FIG. 3C.

Having thus described several aspects of at least one embodiment of this invention, it is to be appreciated various alterations, modifications, and improvements will readily occur to those skilled in the art.

For example, the invention is illustrated in connection with a backplane/daughter card connector system. Its use is not so limited. It may be incorporated into connectors such as are typically described as mid-plane connectors, stacking connectors, mezzanine connectors, or in any other interconnection system.

As a further example, signal conductors are described to be arranged in rows and columns. Unless otherwise clearly indicated, the terms "row" or "column" do not denote a specific orientation. Also, certain conductors are defined as "signal conductors." While such conductors are suitable for carrying high speed electrical signals, not all signal conductors need be employed in that fashion. For example, some signal conductors may be connected to ground or may simply be unused when the connector is installed in an electronic system.

Similarly, the term "front housing" is used. Unless clearly indicated the term "front" need not apply to any specific orientation. For example, in a mezzanine connector, the "front housing" may be oriented in an upwards direction and may also be described as a top housing.

Further, though the columns are all shown to have the same number of signal conductors, the invention is not limited to use in interconnection systems with rectangular arrays of conductors. Nor is it necessary that every position within a column be occupied with a signal conductor.

Likewise, some conductors are described as ground or reference conductors. Such connectors are suitable for making connections to ground, but need not be used in that fashion.

Also, the term "ground" is used herein to signify a reference potential. For example, a ground could be a positive or negative supply and need not be limited to earth ground.

Such alterations, modifications, and improvements are intended to be part of this disclosure, and are intended to be within the spirit and scope of the invention. Accordingly, the foregoing description and drawings are by way of example only.

What is claimed is:

1. An electrical connector, comprising:

a plurality of signal conductors;

at least one insulative material adopted to be positioned next to at least a portion of the plurality of signal conductors, the at least one insulative material having a plurality of cavities; and a plurality of individual electrically lossy material elements separate from each other, each adapted to be inserted into a respective one of the plurality of cavities.

2. The electrical connector of claim 1, wherein the plurality of individual lossy material elements are positioned to improve performance of the electrical connector.

3. The electrical connector of claim 1, wherein the plurality of individual lossy material elements include nickel-coated graphite flakes.

4. The electrical connector of claim 1, wherein the signal conductors and the individual electrically lossy material elements are longitudinally aligned with each other.

5. The electrical connector of claim 1, wherein the electrically lossy material elements comprise conductive particles and a binder.

6. The electrical connector of claim 1, wherein the electrically lossy material elements have a conductivity between 1 Sieman/meter and $6.1\times10^7$ Siemans/meter.

7. The electrical connector of claim 1, wherein the electrically lossy material elements have a surface resistivity between 1 Ω/square and $10^6$ Ω/square.

8. The electrical connector of claim 1 further comprising a shield member.

9. The electrical connector of claim 8, wherein the shield member is electrically coupled to ground.

10. The electrical connector of claim 8, wherein the shield member is positioned relative to the plurality of signal conductors such that an impedance of each signal conductor is less than approximately 500 Ω.

11. The electrical connector of claim 8, wherein the shield member is positioned relative to the plurality of signal conductors such that an impedance of each signal conductor is less than approximately 100 Ω.

12. The electrical connector of claim 1, wherein the electrical connector comprises at least one insulative housing.

13. The electrical connector of claim 12, wherein the insulative housing includes the at least one insulative material.

14. An electrical connector, comprising:

insulative material having a plurality of cavities;

a plurality of signal conductors, at least one of said plurality of signal conductors positioned adjacent a respective one of said cavities; and a plurality of individual electrically lossy material elements separate from each other, each adapted to be inserted into a respective one of the plurality of cavities.

* * * * *